United States Patent [19]

Yoshimura

[11] 4,366,755

[45] Jan. 4, 1983

[54] SCALE PRINTING INSTRUMENT

[76] Inventor: Minoru Yoshimura, 55-2 Aoki-cho, Ohgaki-shi, Gifu-Ken, Japan

[21] Appl. No.: 245,409

[22] Filed: Mar. 19, 1981

[30] Foreign Application Priority Data

Mar. 19, 1980 [JP] Japan ..... 55/35187

[51] Int. Cl.[3] ..... B41F 5/00

[52] U.S. Cl. ..... 101/329; 33/37; 33/38; 101/110; 101/205

[58] Field of Search ..... 101/327-329, 101/5, 364, 205, 206, 110; 33/33-38

[56] References Cited

U.S. PATENT DOCUMENTS

| | | | |
|---|---|---|---|
| 158,014 | 12/1874 | Baldwin | 101/329 |
| 166,162 | 7/1875 | Truworthyl | 101/329 |
| 168,362 | 10/1875 | Worrell | 101/329 |
| 481,969 | 9/1892 | Pickup | 101/329 |
| 2,237,228 | 4/1941 | Jobe | 101/329 |
| 2,513,419 | 7/1950 | Mann | 101/329 X |
| 2,562,557 | 7/1951 | Limberg | 101/329 |
| 2,763,206 | 9/1956 | Alessi, Jr. | 101/329 |
| 3,046,884 | 7/1962 | Pearson | 101/5 X |
| 3,299,803 | 1/1967 | Taylor | 101/5 |
| 3,646,885 | 3/1972 | Kolody | 101/110 |

FOREIGN PATENT DOCUMENTS

| | | | |
|---|---|---|---|
| 1002231 | 3/1952 | France | 101/329 |
| 6568 | 4/1893 | Switzerland | 101/329 |

*Primary Examiner*—E. H. Eickholt

*Attorney, Agent, or Firm*—Flynn, Thiel, Boutell & Tanis

[57] ABSTRACT

A scale printing instrument wherein one or more printing toothed wheels are rotatably held by a tip end of a grip member, an arm is carried by said grip and a brush containing a printing composition such as ink is provided at a tip end of said arm. With this instrument, when the wheel or wheels are run on paper while keeping the wheel or wheels in contact with the paper, the ink is furnished to the toothed wheel to print a scale having given intervals on the paper.

9 Claims, 40 Drawing Figures

FID. 4C

SCALE PRINTING INSTRUMENT

BACKGROUND OF THE INVENTION

Field of the Invention

This invention relates to a scale printing or marking instrument, and more particularly to a scale printing or marking instrument which is capable of accurately and quickly marking a scale having given intervals and allowing a pattern having given intervals for artistic or ornamental indication or expression to be drawn in a figure, chart, diagram, etc. for making a design drawing in the fields of civil engineering, architectural engineering, mechanical engineering, electric and electronic engineering, etc., such as a building design drawing, a working diagram, a tile distribution drawing, interior design drawing, etc.

Heretofore, in the drawing operations as described above, it has been required to put fine graduation marks at a required portion in the drawing, by hand, using a graduated scale. The operating efficiencies of these scale marking operations have been extremely low as compared with essential operations of design or drawing. In addition, it has been difficult to accurately reproduce a number of continuous graduation marks onto the drawing.

When transparent or translucent paper such as tracing paper or tracing cloth is used in combination with section paper placed under the paper, marks or patterns having accurate intervals can be reproduced on the paper without using a scale. The operation efficiency cannot be improved due to difficulty in registering with a reference point or line or trouble in an operation of selectively omitting unnecessary lines.

OBJECT OF THE PRESENT INVENTION

It is therefore an object of the present invention to provide a scale printing or marking instrument which is capable of easily and quickly printing a series of dots having accurate intervals in a desired length, to obtain a desired continuous pattern in a short time.

It is another object of the present invention to provide a scale printing or marking instrument which is capable of printing scale marks directly in a desired portion of a drawing, chart, diagram, etc.

It is a further object of the present invention to provide a scale printing or marking instrument which is capable of providing, by printing scale marks on a tape made of the same paper as the paper on which a drawing etc. is borne, a flexible scale which can be used as a reference scale throughout a drawing operation because the papers have the same degree of shrinkage due to a change in temperature or humidity.

SUMMARY OF THE INVENTION

In accordance with the present invention, there is provided a scale printing instrument which comprises: at least one printing toothed wheel; a holding member holding said toothed wheel in a position where serrated edges of said toothed wheel are contactable with a surface of a material on which a scale is printed, while allowing said toothed wheel to rotate freely; a brush member for furnishing a printing composition to said toothed wheel; and an arm member secured to said holding member for holding said brush member.

BRIEF DESCRIPTION OF THE DRAWINGS

FIGS. 4A to 4E and FIGS. 5A and 5B show various drawing methods using the scale printing instrument illustrated in FIGS. 1A to 1C;

FIGS. 6 to 19 show various application examples of drawings made by using the scale printing instrument illustrated in FIGS. 1A to 1C: FIG. 6 is a tile distribution drawing; FIG. 7 is an iron reinforcing rod distribution drawing; FIG. 7 is an iron reinforcing rod distribution drawing; FIG. 8 is a drawing showing artistic or ornamental expressions; FIG. 9 is indication of ranges; and FIG. 10 is a sectional view;

FIG. 15 is a front view of a still further modified form of scale printing instrument;

FIG. 16 is a diagram for showing a relationship between the tooth number of the toothed wheel on the scale printing instrument and the diameter of the toothed wheel;

FIG. 17 is a diagrammatic view of toothed wheel having a start mark;

FIGS. 18 and 19 are similar diagrammatic views of a toothed wheel having another form of start mark.

DESCRIPTION OF THE EMBODIMENTS

Figure 1A:
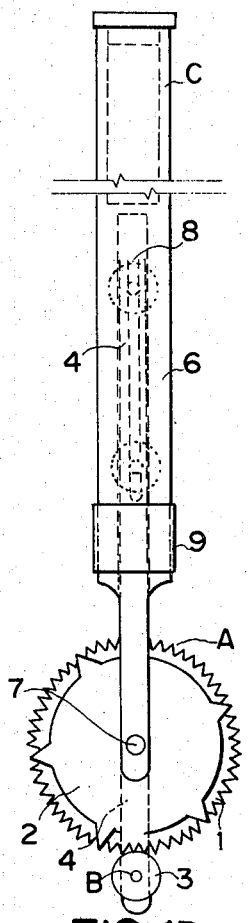
FIG. 1A is a front view of one form of printing instrument according to the present invention.
Figure 1B:
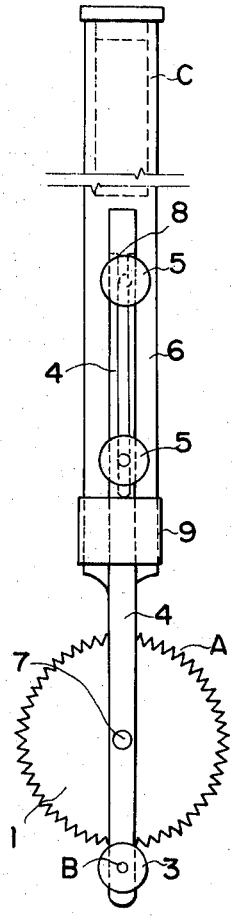
FIG. 1B is a rear view of the scale printing instrument of FIG. 1A.
Figure 1C:
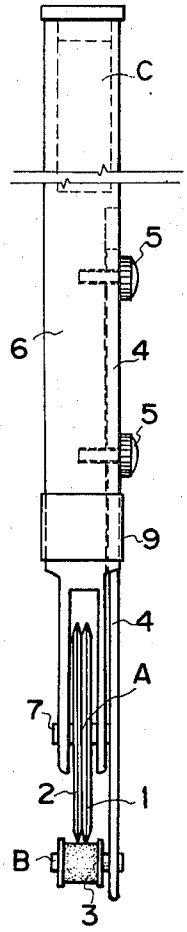
FIG. 1C is a side view of the scale printing instrument of FIG. 1A.
Figure 1D:
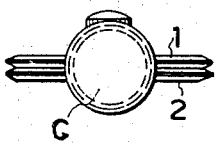
FIG. 1D is a top view of the scale printing instrument of FIG. 1A.
Figure 1E:
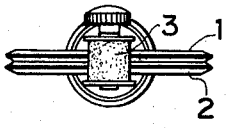
FIG. 1E is a bottom view of the scale printing instrument of FIG. 1A.

FIGS. 1A to 1E illustrate one embodiment of the present invention. A is a toothed wheel mechanism portion, B is a brush mechanism portion and C is a grip portion. 1 and 2 designate toothed wheels of different pitches, respectively. The toothed wheels 1 and 2 may be formed integrally with each other or formed separately and firmly attached to each other for use. 3 is a brush for furnishing printing compositions such as ink, carbon powder, etc. to the wheels, which is operative according to the rotation of the wheels 1 and 2. 4 is a brush holding arm, 5 is a setscrew slidable for adjustment and 6 is a grip. The wheels 1 and 2 are rotatably mounted in a recessed portion formed at a lower end of the grip 6 through a shaft 7. The brush 3 is rotatably fitted to a tip end of the arm 4. This arm 4 is secured to the grip 6 by the screws 5 through a slot formed in the arm 4. When the screws 5 are loosened to allow the arm to slide for adjusting the length of the arm, the contact relation between the wheels and the brush can be adjusted. 9 is a member for connecting the arm 4 to a lower portion of the grip 6.

Figures 2A, 2B, 2C:
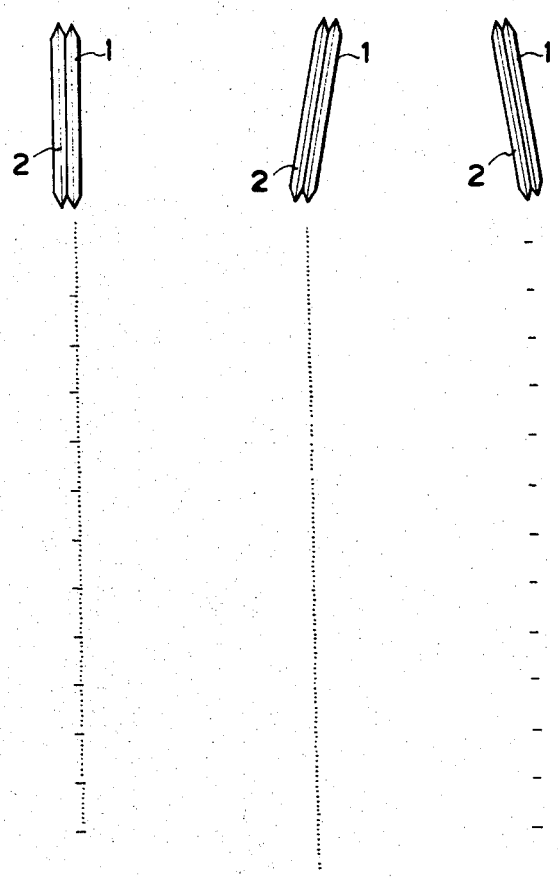
FIGS. 2A to 2C are explanatory views showing three loci formed by the scale printing instrument of FIGS. 1A to 1C.

For instance, when the toothed wheel 1 has a 1 mm pitch and the toothed wheel 2 has a 10 mm pitch, a scale according to the metric system can be printed on the paper to a desired length (FIG. 2A). On the other hand, when only the wheel 1 or 2 is brought into contact with the paper by tilting the grip 6, a scale corresponding to the teeth of the wheel 1 or 2 selected is printed on the paper as illustrated in FIGS. 2B and 2C.

Figure 3A:
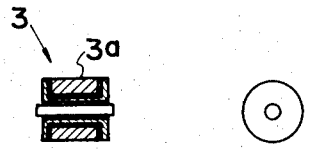
FIGS. 3A to 3C are diagrammatic views showing three brush members, respectively.
Figure 3B:
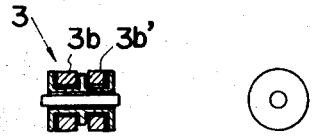
Figure 3C:
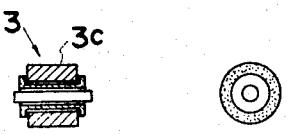

FIGS. 3A to 3C illustrate various forms of the brush 3. FIG. 3A illustrates a pad **3*a* of the brush 3 containing one color ink, FIG. 3B illustrates pads 3*b* and 3*b*' containing different-color inks, respectively, and FIG. 3C illustrates a roller 3*c* of the brush 3 for carrying carbon powder thereon. The pad 3*a* and the pads 3*b* and 3*b*' have arrangements capable of reducing contact with air and the roller 3*c*** has a construction that makes it easy to receive the powder by rolling on the powder.

FIGS. 4 to 10 illustrate drawing methods and drawings to which the instrument of the present invention is applied.

Figures 4A, 4B, 4D, 4E:
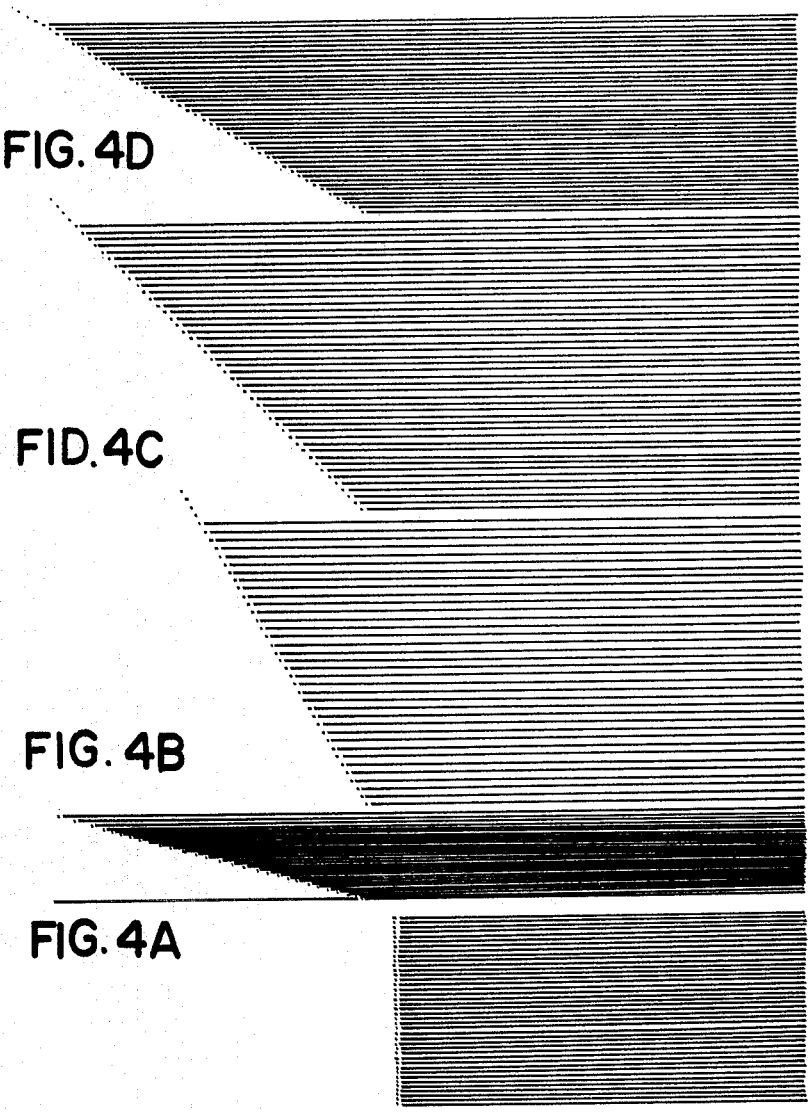
Figures 5A, 5B:
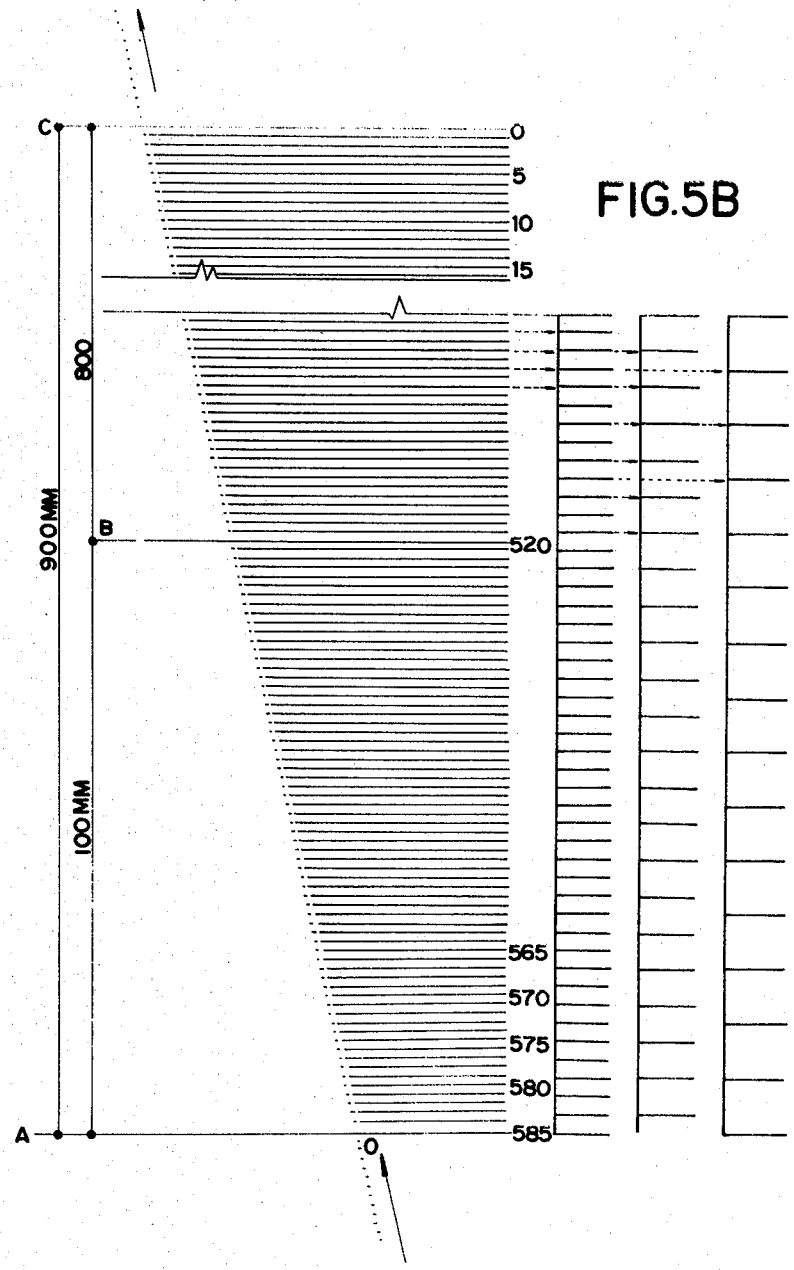

FIG. 4A shows a basic drawing method in which the toothed wheel is run perpendicularly to lines to be drawn over a desired distance where the lines are to be drawn. FIG. 4B shows a method in which the toothed wheel is run obliquely and parallel lines are drawn so as to pass through marks made by the wheel. According to this method, the same effect as that of the basic method wherein a toothed wheel having a smaller pitch is used can be obtained. FIGS. 4C to 4E show examples of parallel lines drawn by using another toothed wheel having a larger pitch. One application of the methods as shown in FIGS. 4A to 4E is as illustrated in FIG. 5A. For example, if a length of 900 mm is to be divided equally into 585, the toothed wheel is run so as to provide a locus of marks which can divide a length of 100 mm into 65 equal parts and the wheel is further run on the extension of the locus to a desired length, i.e., 900 mm.

Where the number of spare toothed wheels is limited, the marks made by one wheel may be picked out regularly as illustrated in FIG. 5B to provide the same effects as can be provided by various toothed wheels. In this case, the marks which have not been picked out may be erased if necessary.

Figure 6:
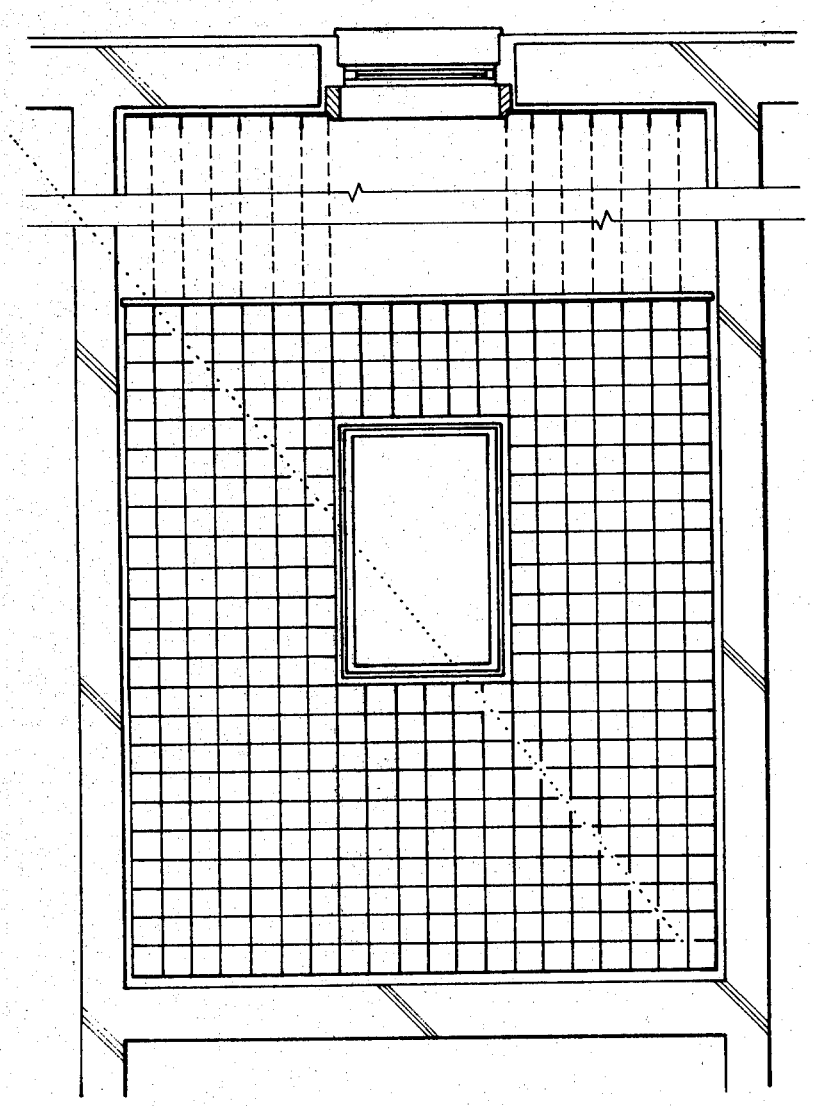

FIG. 6 shows another application of the present invention in which a working drawing for a tile distribution is drawn using the instrument of the present invention. In this application, vertical and horizontal parallel lines are effectively drawn only from an oblique locus of the toothed wheel.

Figure 7:
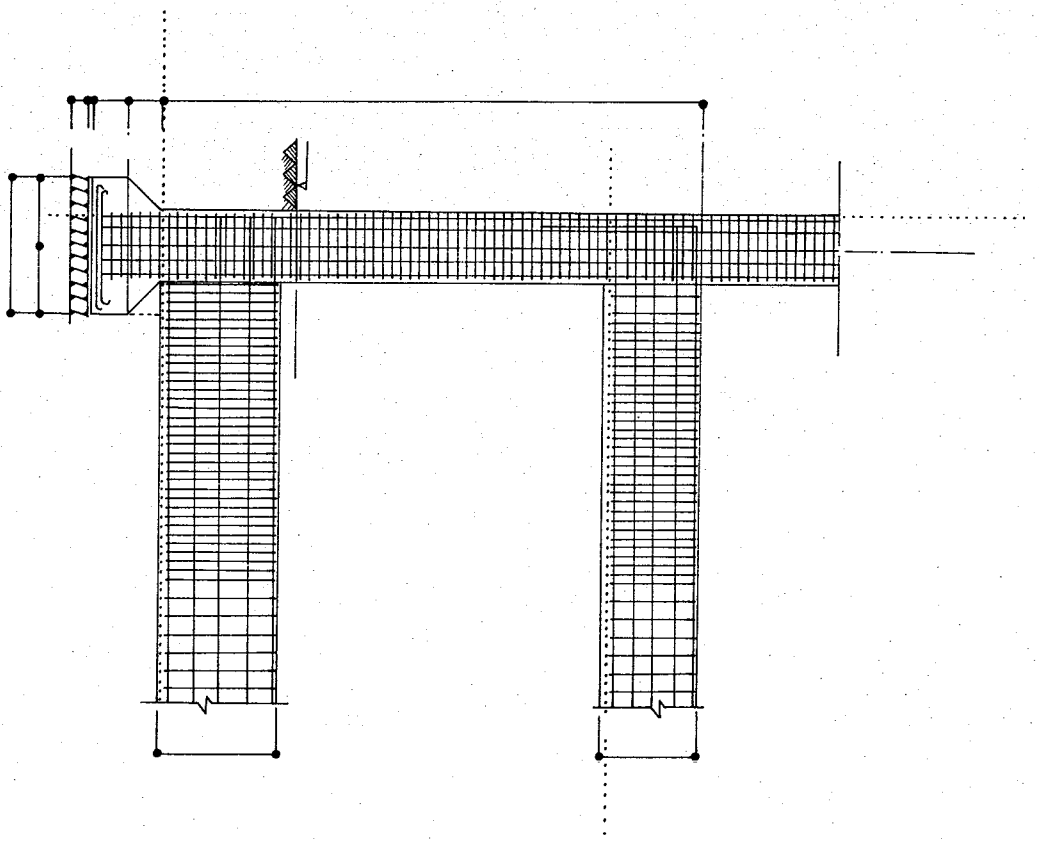

FIG. 7 shows a further application of the present invention in which a distribution diagram of iron reinforcing rods is drawn using the instrument of the present invention. Suitable marks are picked out according to the thickness of the reinforcing rods to be provided.

Figure 8:
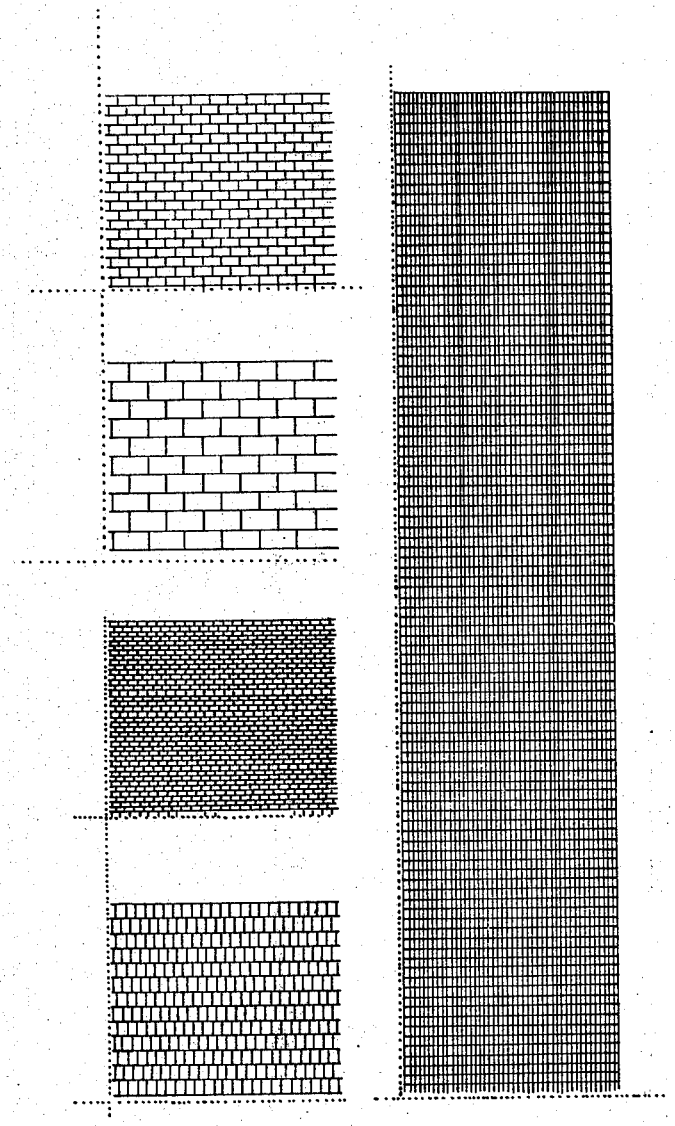

FIG. 8 shows a still further application of the present invention in which a distribution drawing of tiles or an artistic or ornamental expression is provided using the instrument of the present invention. Various drawings or expressions may be provided by changing marks to be picked out.

Figure 9:
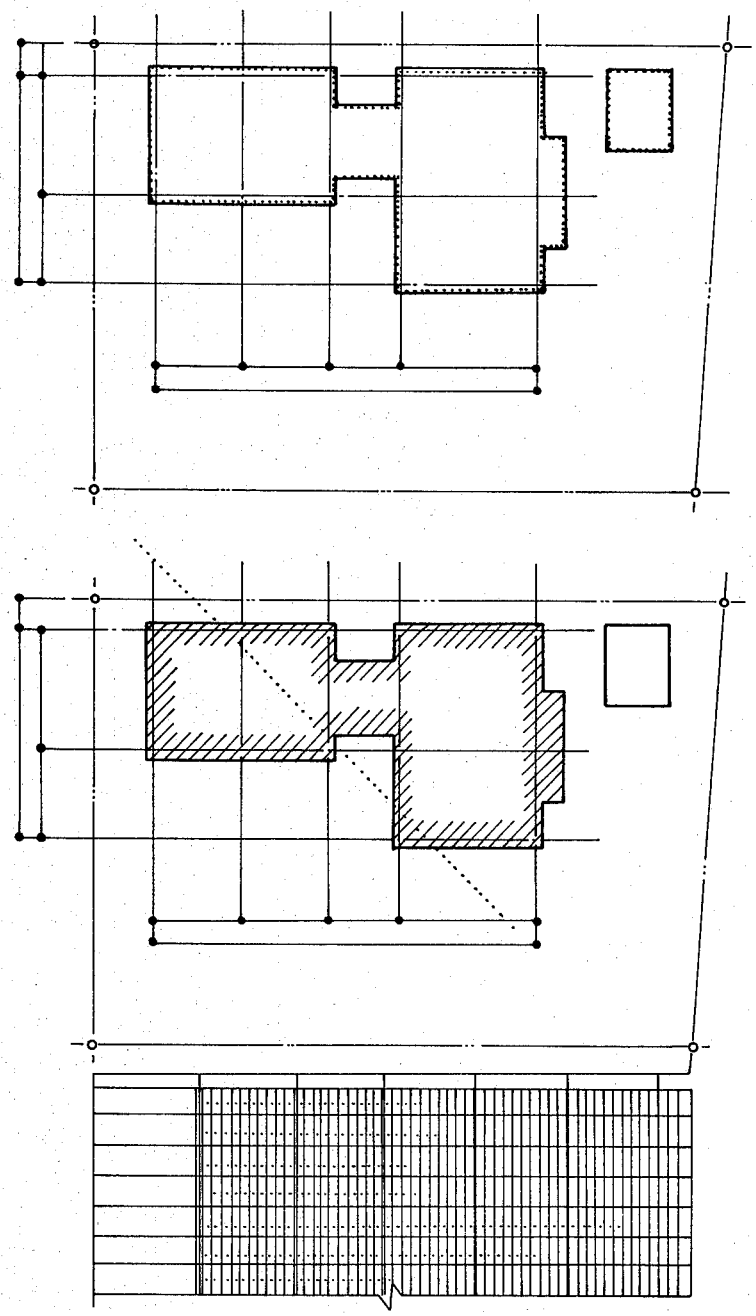

FIG. 9 is a still further application of the present invention wherein a plot plan or range of a building is indicated using the instrument of the present invention. In this application, the present invention provides high efficiency in a hatching operation as compared with a conventional method for drawing the plot plan or indication of range.

Figure 10:
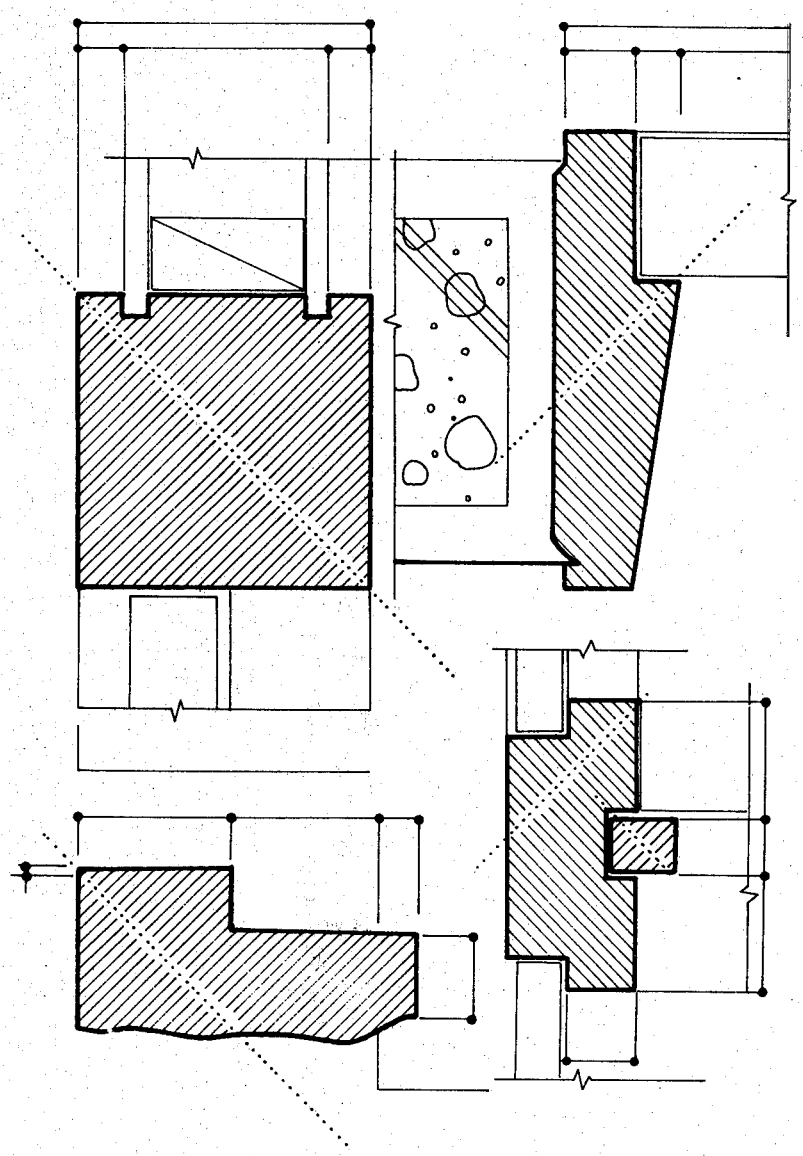

FIG. 10 is a still further application of the present invention, wherein sectional views of fittings etc. are drawn using the instrument of the present invention. The present invention is especially effective in case where there is no need to calculate dimensions etc. but hatching is required.

Various modifications of the scale printing instrument according to the present invention will now be described.

When the paper used for drawing a diagram etc. thereon is thick, or another sheet is placed under the paper used, the force applied to the paper through serrated edges of the teeth of the toothed wheel is not uniform when the instrument is operated by direct holding of the grip 6 by hand, so that there may possibly be caused a slight error in pitch between the marks of the scale printed by the toothed wheel. This is due to the fact that a serrated edge of the teeth bites the paper deeply and the relative distance (pitch) between said edge and the edge of the succeeding tooth is varied to cause an error. This can be solved by a means which is capable of running the toothed wheel with a constant force applied to the paper therethrough.

More specifically, for the operation as illustrated in FIG. 5A, if high accuracy is required, the instrument of the present invention may be provided with a shaft (a grip support shaft) which is fitted to the grip 6 perpendicularly thereto and horizontally with the operating face for allowing the force applied by hand to act in the operational direction but preventing undesired vertical force applied by hand from acting on the toothed wheel at the tip end of the shaft. The grip support shaft may be located at any position on the opposite side of the gravity center of the instrument relative to the toothed wheel 1 (2). The diameter of the grip support shaft may be smaller than the diameter of a hole in the grip through which the support shaft is inserted so as to be loosely fitted in the grip. When the toothed wheel is run by holding the grip support shaft, the force of the tip end of the tooth of the wheel 1 (2) relative to the paper becomes constant. Furthermore, if the teeth are run along a ruler, a more accurate pitch can be obtained.

The weight of the instrument is not critical and may suitably be selected according to necessity.

To prevent the ink from staining papers or other articles on a desk or the hands of the user when the instrument of FIG. 1 is employed, a cover made of any suitable material may be used to cover the instrument except a portion where the wheel contacts the brush. If the cover is made removable, the carbon powder may easily be supplied to the brush.

These modifications will now be described referring to FIGS. 11A to 11D and FIG. 12.

Figure 11A:
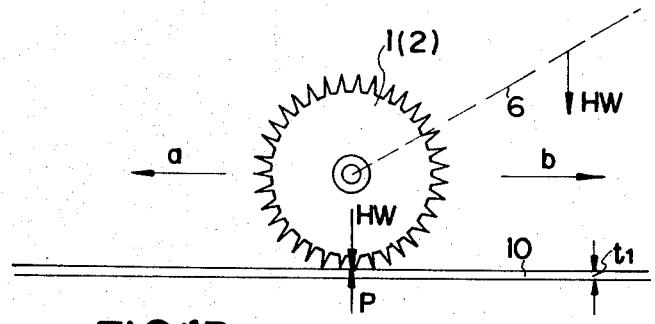
FIGS. 11A to 11C are diagrammatic views showing relationships between the thickness of paper and the edges of a toothed wheel of the scale printing instrument, respectively.

In FIG. 11A, when the wheel 1 (2) is run in the direction of a or b by holding the grip 6 (as shown in FIGS. 11A to 11D by a dotted line), a force HW acts on the paper 10. The force HW is not constant and varies according to the manner in which the grip is handled. P is a counterforce of a surface of the paper 10. P=HW is a ideal condition, but when P<HW, the tip end of the wheel 1 (2) bites deep in the paper 10.

Figure 11B:
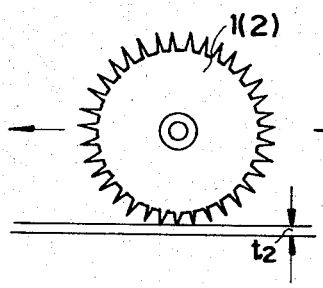

FIG. 11B illustrates a case in which the thickness $t_2$ of the paper 10 is small and the working desk is relatively hard. In this case, the accuracy is high.

Figure 11C:
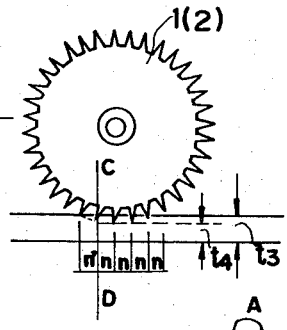

FIG. 11C illustrates a case in which a relatively thick sheet is used for a working board or thick drawing paper is used to draw a figure etc. thereon. In this case, the wheel 1 (2) runs at a level $t_4$ (in the state sunk under the face of the paper) at a pitch n until the force HW is reduced at a position as indicated in FIG. 11C by C–D. At the position C–D, the pitch n′ defined by the succeeding tooth becomes slightly smaller than the pitch n.

Figure 11D:
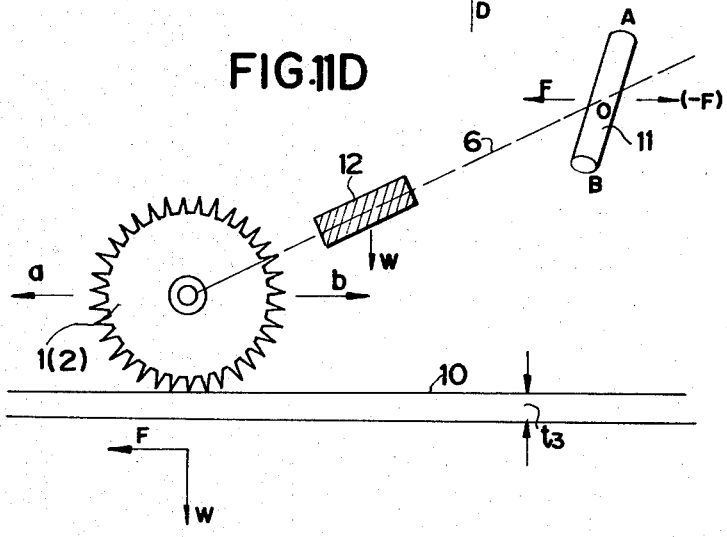
FIG. 11D is a diagrammatic view showing a relationship between the paper and edges of a toothed wheel of a modified form of scale printing instrument according to the present invention.

In FIG. 11D, 11 is said additional shaft inserted through the grip 6. 12 is a weight member having a weight w. When the wheels are run while supporting faces A and B of the grip support shaft 11 with the hands, a force from the hands is not applied to the tip end of the wheel 1 (2) because the grip support shaft 11 is loosely fitted in the grip 6.

If a force applied to the tip end of the wheel 1 (2) when the wheel 1 (2) runs in the direction a by a force F is assumed to be W, the force W is constant determined by the weight w and the weight of the instrument itself. As apparent from the above description, the grip supporting shaft may advantageously by employed to assure high accuracy of pitches printed by the instrument, irrespective of the conditions of the papers.

Figure 12B:
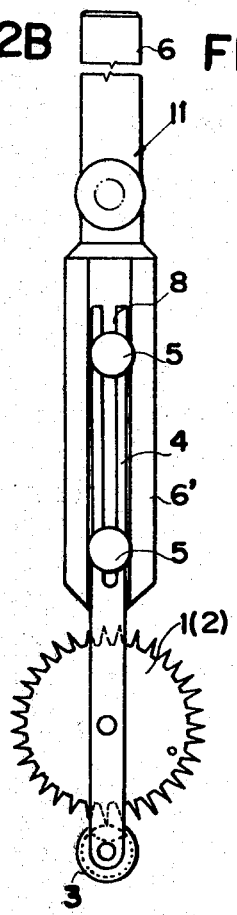
FIG. 12B is a front view of the scale printing instrument of FIG. 12A.
Figure 12C:
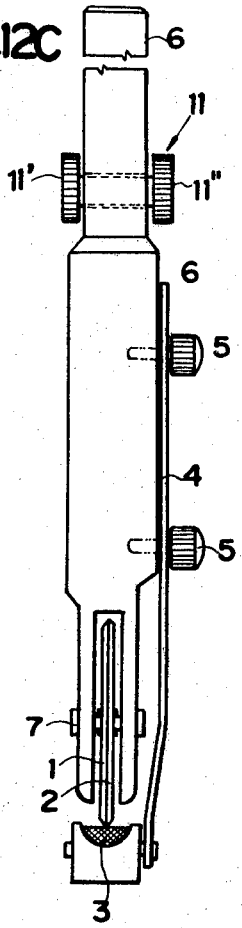
FIG. 12C is a side view of the scale printing instrument of FIG. 12A.
Figure 12A:
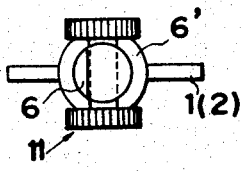
FIG. 12A is a top view of another modified form of scale printing instrument according to the present invention.

FIG. 12 illustrates a modification in which the grip 6 has an increased diameter portion 6′ to increase the weight. Alternatively, this purpose can be attained by a grip of uniform diameter provided with a weight member. The grip support shaft 11 in this modification has enlarged ends 11′ and 11″ so as to be grasped by hands more easily. This purpose is also attainable by any suitable means.

The fluctuation in the pitches of the marks provided by the wheel can alternatively be prevented by employing a guide roller rotatable conjointly with the wheel and having the same diameter as that of the wheel. More specifically, since the edges of the teeth of the wheel are sharp and liable to enter the paper, the guide roller with a smooth periphery having a suitable width is provided so as to prevent the edges of the wheel from sinking into the paper when an excessive force is applied. The edge of the wheel which is concentric with the roller is kept at positions on the face of the paper. The brush is provided at a position where ink can be furnished to the wheel but cannot be furnished to the roller. The pitch of the marks produced by the edges of the wheel with the guide roller can be expressed by:

$$p=2\pi r/\text{number of teeth}$$

Thus, the pitch of the marks can be made constant because it can be expressed in the terms of the arcuate length.

Figures 13A, 13B:
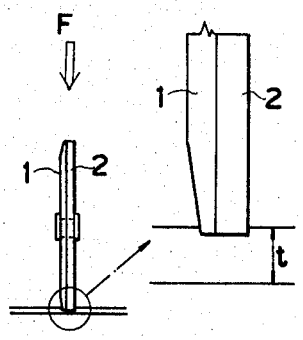
FIGS. 13A and 13B are diagrammatic views showing a relationship between the paper and the edges of the toothed wheel on the scale printing instrument.
Figures 14A, 14B:
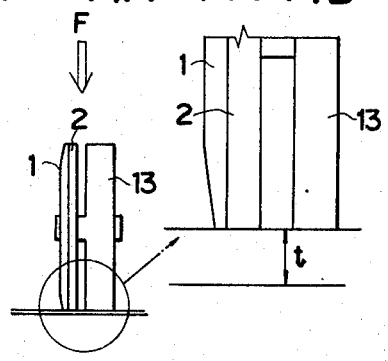
FIGS. 14A and 14B are diagrammatic views showing a relationship between the paper and edges of a toothed wheel on a further modified form of scale printing instrument.
Figure 15:
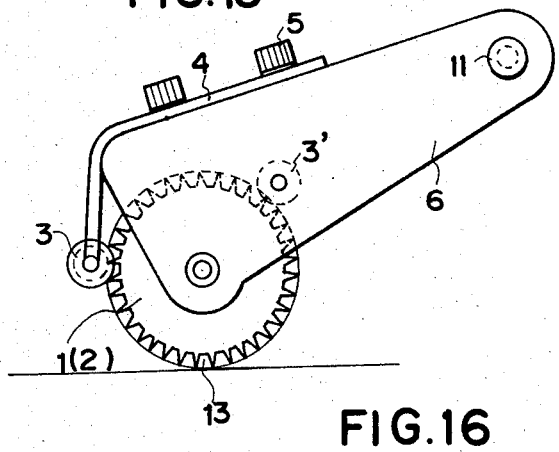

More specifically referring to FIGS. 13A ad 13B, FIGS. 14A and 14B and FIG. 15, the edges of the teeth of the wheel 1 and/or 2 enter the paper 10 in the direction of thickness t thereof when a force F is applied to the wheel through a shaft of the wheel 1 and/or 2. To solve this problem, in the present modification, the guide roller 13 having the same diameter as that of the wheel is provided concentrically with the wheel 1 and/or 2. In this case, the sharp edges of the wheel are kept from entering the paper 10 by the guide roller 13.

FIG. 15 illustrates a further modification of the present invention in which the brush 3 for furnishing the ink may be encased within the grip 6 at a position as shown by 3′ to prevent evaporation of the ink. Alternatively, the pad of the brush may have a cover.

The instrument of the present invention is further applied to a ceiling boarding diagram, a floor boarding diagram, a distribution diagram of stones etc., a distribution diagram of steps, etc. In an estimation operation, dimensions must be read out from the diagram etc. by using, for example, a measure or instrument indicating lengths. However, these instruments do not leave measure marks on the diagram etc., and therefore the dimensions must be again obtained whenever needed. In contrast, since the instrument of the present invention can leave the marks on the drawing when used, it can advantageously pick out necessary dimensions whenever needed. In a conventional distribution diagram, the distribution is made on a scale of 1/20 to 1/30. The accuracy can be improved to 1/50 to 1/100 according to the present invention.

The most important advantage of the present invention is large curtailment of the time required for drawing. As described above, an operation of marking at given intervals necessary for a designer or at a construction field has heretofore been carried out by copying the intervals from a scale whenever necessitated. This operation time can be remarkably reduced by the present invention as compared with that required by the conventional method. For example, when it is required to divide 100 cm into 500 equal parts, the operation can be attained within several seconds using some preliminaries. The time required for preparing the distribution diagram of iron reinforcing rods can also be reduced very much.

Further applications of the present invention will be described.

In the wheel 1 and/or 2, a specified tooth is selected for starting the printing operation. The tooth may have a start indication or mark so as to allow the toother with the indication to start the operation whenever required. Parallel lines can be drawn using a ruler according to the printed scale. The indication is made by punching a hole, putting any suitable sign or coloring the specified tooth.

The scale marks printed on the paper by the edges of the wheel may have any suitable configuration, such as —, ●, ○, ▶, ■.

Figure 20:
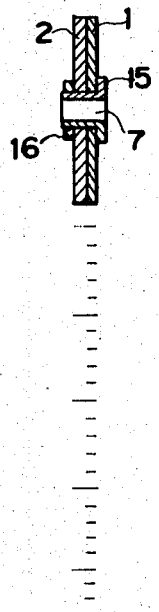
FIG. 20 is a diagrammatic view showing coupling of the toothed wheels.

Since meandering of the wheel may possibly cause error in the marked scale, a press-fit body 15 and a press-fit collar 16 may advantageously be provided as illustrated in FIG. 20 to increase the area where the wheel 1 and/or 2 contacts the shaft 7 for preventing the meandering of the wheel. To this end, the wheels may be attached to each other more firmly by press-fitting or caulking. The number of the wheels to be provided on the instrument is not limited to two, and three or more wheels may be employed. The thickness of the wheels may be varied according to necessity.

When three wheels are employed, a first wheel may have the smallest pitch, a second wheel may have a pitch which has a tooth for every five teeth of the first wheel so that the marks produced thereby can be counted as 5, 10, 15 . . . , and a third wheel may have a tooth for every 10 teeth of the first wheel so that the marks produced by the third wheel can be counted as 10, 20, 30 . . . . When the pitch of the first wheel is 1 mm, the marks produced form a scale of the metric system. If these marks are printed on a tape, a measuring scale is provided.

Heretofore, it has been impossible to place a scale or a triangle under a T-square or a parallel straight-edge and move vertically or laterally thereon because the scale has a considerable thickness. This problem can be overcome by using a tape scale provided by the instrument of the present invention. Only marks having the desired pitch can be printed by selecting a wheel having the desired pitch. Thus, unnecessary marks can be omitted to facilitate reading of the scale.

Openings may be formed on the wheels to reduce inertia of the wheels.

Figure 16:
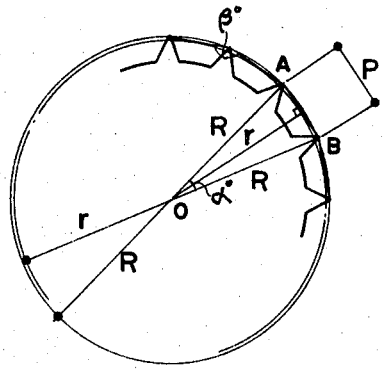

The toothed wheel of the present invention has a relationship between the pitch and the diameter as illustrated in FIG. 16 different from an ordinary gear such as a cycloid gear, an involute gear, etc.

In FIG. 16, there are relations:

$$r = \frac{P}{2} \cdot \cot \frac{180°}{n} = R \cos \frac{180°}{n}$$

$$R = \frac{r}{\cos \frac{180°}{n}} = \frac{P}{2 \sin \frac{180°}{n}}$$

$$P = 2 R \sin \frac{180°}{n}$$

$$= 2 \sqrt{R^2 - r^2}$$

For example, when the number of teeth is 100 and a pitch is 1.0 mm, a distance R from the center O of the wheel and the edges A or B is:

$$R = \frac{1}{2 \sin \frac{180°}{n}}$$

$$= \frac{1}{2 \sin \frac{180°}{100}}$$

$$= \frac{1}{2 \times 0.031411}$$

$$R = 15.91799$$

Figure 17:
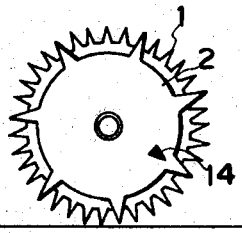

FIG. 17 illustrates a wheel having a start indication 14 as described above which may be printed on the wheel or punched from the wheel in any desired shape.

Figure 18:
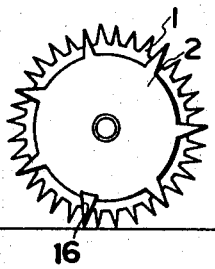
Figure 19:
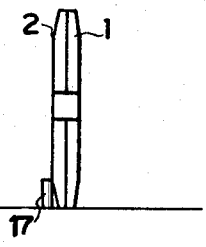

FIGS. 18 and 19 illustrate wheels with start indications 16 and 17 having the shape of teeth edge portions attached to the wheel 2.

The toothed wheels employable in the present invention may be tapered at edge portions thereof so as to easily and smoothly run along the ruler.

I claim:

1. A scale printing instrument which comprises:

an elongated hand grip having a pair of straight, elongated, parallel, laterally spaced-apart legs extending longitudinally from one end of said hand grip, said legs defining a recess therebetween which is open at the end thereof remote from said hand grip;

a wheel, said wheel being a planar disc having a multiplicity of uniformly circumferentially spaced-apart, radially outwardly projecting teeth on the entirety of the periphery thereof, said wheel being disposed in said recess so that its plane is parallel with said legs and the periphery of said wheel extending outwardly of the sides and said end of said legs so that the periphery of said wheel is uncovered and exposed except where said legs are joined to said hand grip;

an axle extending between said legs and passing through a central opening in said wheel so that said wheel is supported on said axle for free rotation with respect to said hand grip and said legs;

an elongated, straight arm extending longitudinally along one side of said hand grip and thence extending longitudinally alongside of and parallel with one of said legs and thence extending beyond said end of said one leg and beyond the periphery of said wheel, means supporting said arm on said hand grip for slidable movement in a direction lengthwise of said hand grip and said legs and means for releasably securing said arm to said hand grip to hold said arm in an adjusted position;

and a circular brush mounted on said arm adjacent to the end thereof remote from said hand grip, said brush projecting laterally from said arm to a location adjacent the periphery of said wheel for contact with the apexes of said teeth as said wheel rotates with respect to said hand grip to deposit marking material thereon, said brush being mounted for rotation on said arm about an axis of rotation parallel with the axis of rotation of said wheel.

2. A scale printing instrument according to claim 1, further comprising a grip support shaft extending through said hand grip, said grip support shaft having enlarged ends so that said instrument can be grasped more easily.

3. A scale printing instrument according to claim 1, further comprising a second toothed wheel mounted for integral rotation concentrically with the first-mentioned wheel on said axle, the apexes of the teeth of said second wheel being located the same distance from said axle as the apexes of the teeth of the first-mentioned wheel and the pitch of the teeth of said second wheel being different from the pitch of the teeth of the first-mentioned wheel.

4. A scale printing instrument according to claim 1, wherein said arm has a groove extending longitudinally thereof and said means for releasably securing said arm to said hand grip comprises screws extending through said groove in said arm.

5. A scale printing instrument according to claim 3, wherein said brush comprises two separate marking material portions adapted to deposit marking materials of different colors on each of said wheels, respectively.

6. A scale printing instrument according to claim 1, which further comprises a grip support shaft member provided on said hand grip and extending perpendicularly thereto.

7. A scale printing instrument according to claim 6, wherein said hand grip is provided with a weight member for adding a suitable amount of weight to said hand grip.

8. A scale printing instrument according to claim 1, which further comprises a guide roller having the same diameter as that of said wheel and mounted on said axle concentrically with said wheel.

9. A scale printing instrument according to claim 1, wherein a start mark is provided on a given tooth of said wheel.

* * * * *